US008070918B2

(12) United States Patent
Suzuki et al.

(10) Patent No.: US 8,070,918 B2
(45) Date of Patent: Dec. 6, 2011

(54) METAL-COATED TEXTILE

(75) Inventors: Takahiro Suzuki, Gamagori (JP); Masayuki Suzuki, Nukata-gun (JP); Naoya Takahashi, Gamagori (JP)

(73) Assignee: Sekisui Nano Coat Technology Co., Ltd., Gamagori-shi (JP)

( * ) Notice: Subject to any disclaimer, the term of this patent is extended or adjusted under 35 U.S.C. 154(b) by 671 days.

(21) Appl. No.: 11/662,690

(22) PCT Filed: Sep. 15, 2004

(86) PCT No.: PCT/IB2004/003046

§ 371 (c)(1), (2), (4) Date: Jan. 28, 2008

(87) PCT Pub. No.: WO2006/030254

PCT Pub. Date: Mar. 23, 2006

(65) Prior Publication Data

US 2008/0260998 A1 Oct. 23, 2008

(51) Int. Cl.
*C23C 14/00* (2006.01)
*B32B 3/00* (2006.01)

(52) U.S. Cl. ..... 204/192.15; 204/298.24; 428/164; 428/336; 428/337

(58) Field of Classification Search ..... 428/164, 428/336–337
See application file for complete search history.

(56) References Cited

U.S. PATENT DOCUMENTS

| | | | |
|---|---|---|---|
| 4,816,124 | A | 3/1989 | Manabe et al. |
| 5,089,105 | A | 2/1992 | Tsutsui |
| 6,875,478 | B2 * | 4/2005 | Yoshikawa et al. ..... 427/471 |

FOREIGN PATENT DOCUMENTS

| | | | |
|---|---|---|---|
| DE | 3436097 | A1 | 5/1985 |
| EP | 1231292 | A1 | 8/2002 |
| JP | 60-75669 | | 4/1985 |
| JP | 60-110969 | A | 6/1985 |
| JP | 60-110970 | A | 6/1985 |
| JP | 60-110971 | A | 6/1985 |
| JP | 60-110972 | A | 6/1985 |
| JP | 60-134039 | A | 7/1985 |
| JP | 60-134067 | A | 7/1985 |
| JP | 60-134068 | A | 7/1985 |
| JP | 61-177239 | A | 8/1986 |
| JP | 61-179377 | A | 8/1986 |
| JP | 62-021870 | A | 1/1987 |
| JP | 2-62237 | A | 3/1990 |
| JP | 5-033272 | A | 2/1993 |
| JP | 8-215295 | A | 8/1996 |

(Continued)

*Primary Examiner* — Lynda Salvatore
(74) *Attorney, Agent, or Firm* — Day Pitney LLP

(57) ABSTRACT

An improved metal coated textile and its production method where the coating of metal is deposited onto the textile through sputtering process in thickness between 20 to 2000 angstroms, with less than 5% variance in thickness across the entire length and width of the textile with width up to and over 10000 mm and length up to and over 1000 meters. The improved sputtering process utilizes longer cathodes, arrangements of metal target(s), tension controller with tension meter(s), guard(s), cylinder cover(s), and control over the textile while traveling through the chamber. The metal layer deposited is highly adhesive to the textile and is suitable for producing clothing, swim wear, diving suit, tent, cushion, wall paper, curtain, carpet, protective cover, screen window, equipment casing, and various other items. The metal layer confers characteristics such as anti-bacterial, deodorizing, improved metallic appearance and texture, electrical conductivity, heat-shielding, heat retention, and dirt repellency to the textile.

9 Claims, 7 Drawing Sheets

FOREIGN PATENT DOCUMENTS

| | | | |
|---|---|---|---|
| JP | 10-216210 | A | 8/1998 |
| JP | 11-021763 | A | 1/1999 |
| JP | 11-253539 | A | 4/1999 |
| JP | 2000-314039 | A | 11/2000 |
| JP | 2001-040546 | A | 2/2001 |
| JP | 2001-115252 | A | 4/2001 |
| JP | 2001-159071 | A | 6/2001 |
| JP | 2001-172761 | A | 6/2001 |
| JP | 2002-004170 | A | 1/2002 |
| JP | 2002-030566 | A | 1/2002 |
| JP | 2002-105853 | A | 1/2002 |
| JP | 2003-042296 | A | 2/2003 |
| WO | WO 03/091472 | A1 | 11/2003 |

* cited by examiner

FIG. 4 (a)
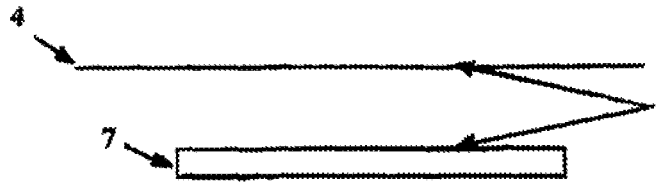
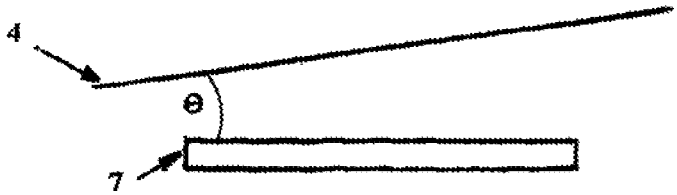
FIG. 4 (b)
FIG. 5 (a)
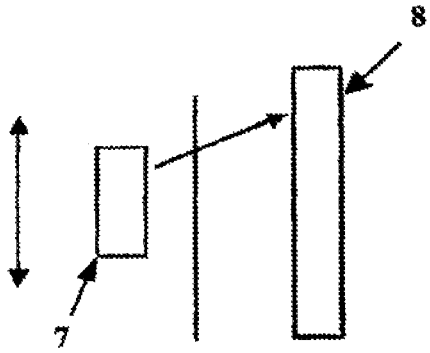
FIG. 5 (b)
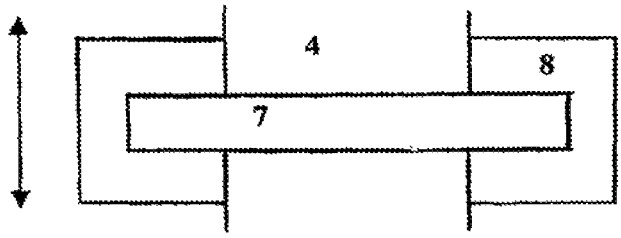

METAL-COATED TEXTILE

FIELD OF THE INVENTION

The present invention relates to a metal-coated textile product suitable for clothing, swim wear, diving suit, tent, cushion, wall paper, curtain, carpet, protective cover, screen window, equipment casing, and various other items, wherein the coating of metal is deposited onto the textile product in thin, even, highly adhesive layer or layers, as metal, oxidized metal, or nitrogenized metal through physical vapor depositing process, known as the sputtering process.

BACKGROUND OF THE INVENTION

By forming a metallic, oxidized metal, or nitrogenized metal coating or a layer, of such deposit on the surface of a textile product, various types of functions can be conferred on the textile such as electrical conductivity, heat-shielding, heat retention, dirt repellency, anti-bacterial properties, deodorizing properties, enhanced visual appearance, and creation of a metallic appearance to the textile.

Various methods of depositing metal, oxidized metal or nitrogenized metal layer onto a textile are known, such as ion-beam deposit, vacuum vapor deposit, and sputtering method.

This invention is an improvement to the sputtering method as disclosed by one of the applicant along with other inventors in U.S. Pat. No. 4,816,124 and in several other subsequently disclosed patent applications and publications on sputtering process on textile and fabric products such as JP60-134068, JP60-134067, JP60-110972, JP60-75669, JP60-110971, JP60-110970, JP60-110969, JP60-134039, JP61-179377, JP61-177239, JP62-21870, JP2-62237, JP5-033272, JP8-215295, JP10-216210, JP11-021763, JP11-253539, JP2000-314039,JP2001-040546, JP2001-115252, JP2001-159071, JP2001-172761, JP2002-004170, JP2002-030566, JP2002-105853, JP2003-042296, and JP2003-313771.

More specifically, this invention relates to an improved manufacturing method and the improved textile product produced from the improved sputtering method of depositing metal, oxidized metal, and nitrogenized metal onto the textile. The improved manufacturing allows sputtering metal onto the textile at a higher rate of speed, higher precision and accuracy, which result in increased production efficiency and speed, increase in width and length of the processed textile, and improved quality of the product with higher adhesion of the deposited metal layer to the textile, and the layer of deposit may be thicker, more even, and cover the entire length and width of the textile.

As a result of this improved sputtering process and product produced from this method, the production cost for the textile is reduced, more valuable and marketable product is produced, and the product is more aesthetically pleasing, with the layer of metal deposited is more durable, and depending on the type of metal or metals deposited, confers such characteristics to the textile such as anti-bacterial quality, deodorizing quality, improved appearance and texture, electrical conductivity, heat-shielding, heat retention, and dirt repellency.

SUMMARY OF THE INVENTION

An object of this invention is to offer metal, oxidized metal, or nitrogenized metal coated textile through improved sputtering method. The textile product may be woven or knitted, non-woven, such as spun-bonded, spun-laced, chemical-bonded hot melt thermal-bonded, needle punched textile or may be of foam sheet, such as polyurethane sheet. The material forming the textile may be of synthetic organic fibers such as polyester, polyethylene or other fiber materials, non-organic fibers such as glass fibers, carbon fibers and other fiber materials, mixture or combination of such fibers, or mixture of combination of the synthetic fibers and non-organic fibers with other natural fibers. By depositing a layer of metal, oxidized metal, or nitrogenized metal utilizing the sputtering method, textile with aesthetically pleasing metallic appearance is created. The adhesion of the coated layer is excellent and the coated layer is very hard to remove, chip away, or wear away. The coating layer also confers various characteristics to the textile such as anti-bacterial quality, deodorizing quality, improved appearance and texture, electrical conductivity, heat-shielding, heat retention, and dirt repellency.

Another object of this invention is an improved production method of such metal, oxidized metal, or nitrogenized metal coated textile, which the process time for the sputter coating process is reduced through faster movement of textile through the sputtering apparatus. The increase in the speed is enabled through various improvements, such as placing the target at an optimal angle and more precise control of the atmosphere inside the sputtering apparatus's chamber.

Another object of this invention is an improved textile product produced from the improved production method, which the layer deposited on the textile has very little variance in the thickness of the layer, both lengthwise and widthwise.

Another object of this invention is an improved textile product produced from the improved production method, which the width may be as wide as 10000 mm and the coating layer deposited extends all the way to the edge of the textile, both lengthwise and widthwise, while the entire length of the processed textile may as long as 1000 m, or longer.

BRIEF DESCRIPTION OF THE DRAWING

FIG. 4*a* is an example of sputter cathode 7 and textile 4 in parallel arrangement.

FIG. 4*b* is an example of sputter cathode 7 and textile 4 in an arrangement at an angle.

FIG. 5*a* is an example of textile 4, sputter cathode 7 and guard plate 8 arrangement viewed from above.

FIG. 5*b* is a side view of textile 4, sputter cathode 7 and guard plate 8 arrangement.

DETAILED DESCRIPTION OF THE PREFERRED EMBODIMENTS

The preferred embodiments of the present invention will be explained with references to FIGS. 1 through 11.

Figure 1:
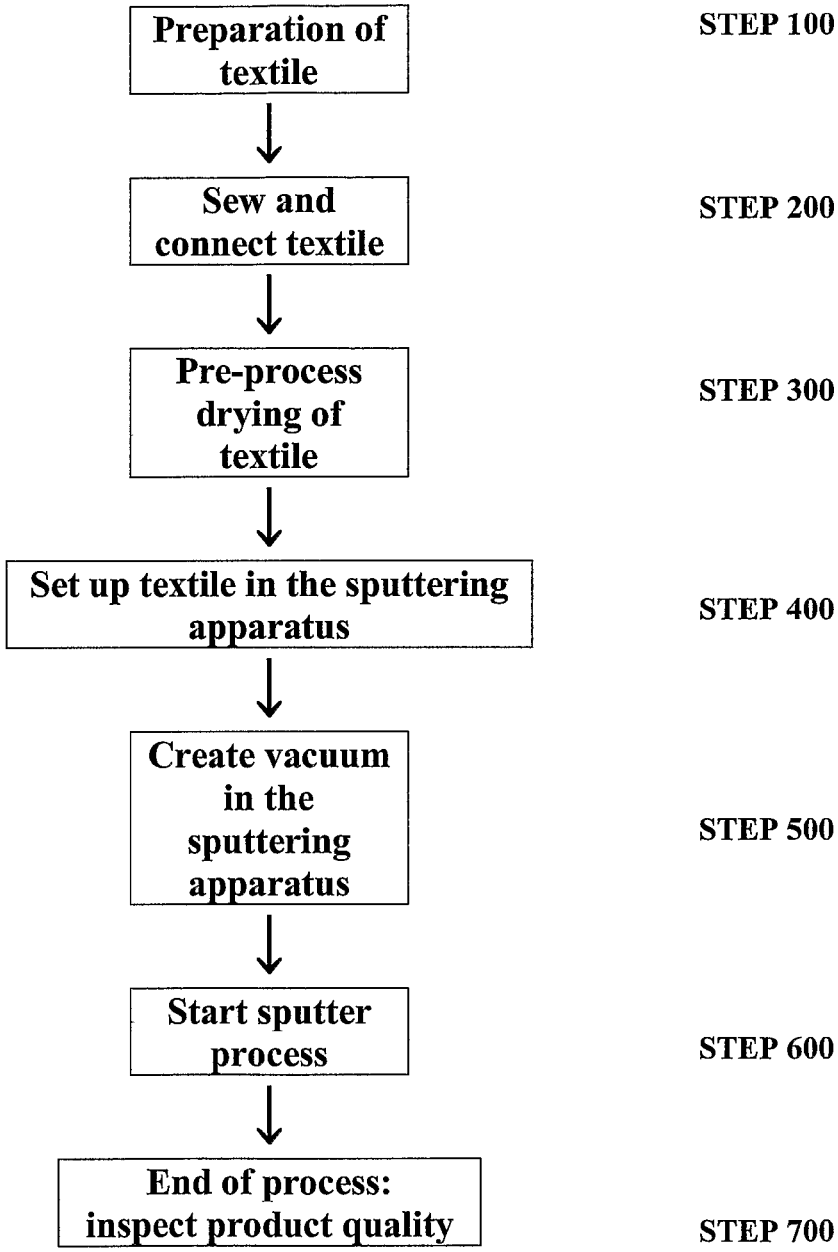
FIG. 1 is a flow chart of sputtering process.

Under the first preferred embodiment, as in FIG. 1, Step 100, the textile 4 to be processed is to be completely free from any resin material. The textile 4 is to be dry, and textile 4 with low water absorption property, such as polyethylene and polyester is preferable. In Step 200, the textile 4, usually in 50 meters spools are sewn together to create a spool of textile 4 with a length of several of hundred meters up to 1000 meters.

In Step 300, although dry textile 4 is selected in Step 100, the textile 4 is further dried to reduce the time required to create a vacuum inside the chamber of the sputtering apparatus. The textile 4 measuring several hundred meters to up to and over 1000 meters wound on one spool or drum, is placed inside the chamber of the sputtering apparatus in Step 400.

In Step 500, using a vacuum pomp, air is pumped out of the chamber for a period of 30 minutes up to 3 hours to create a vacuum inside the sputtering apparatus's sputtering chamber. First a pump is used to roughly remove air from the chambers to create a low level of vacuum, and next the main pump is used in combination of freezing panel (temperature −120~150 C.°) to increase suction of air to create a high level of vacuum.

Once a high level of vacuum is created, in Step 600, plasma is created inside the chamber of the sputtering apparatus and metallic deposit is sputtered onto the textile 4. The sputtering occurs as the textile 4 is transferred from a releasing drum 11 to a rewinding drum 10 of textile 4 and the cylinder 6, where the metal is sputtered, is cooled to allow the sputtering process to go on for a long period of time. The sputtering process is controlled by adjusting the distance between the metal target 12, temperature of the textile 4 and cylinder 6, and also taking into consideration, the heat resistance of the textile and the desired thickness of the metallic layer to be deposited onto the textile 4. Depending on the desired function of the finished textile 4 (e.g. electromagnetic shield, heat shield, heat retention, photo-catalytic properties, etc), the thickness and color of the metallic layer deposited on the textile 4 is controlled.

In Step 700, the textile 4 with the metal layer deposited is inspected for wrinkles, defects, and for evenness of the deposited metal layer.

Under the second preferred embodiment, the sputtering process performed to the surface of a textile 4 is carried out in a sputtering apparatus designed and used exclusively for processing textile 4. Any metal or alloy, its oxidized form, or its nitrogenized form or combination thereof that may be sputtered, such as gold, silver, aluminum, tin, zinc, nickel, copper, cobalt, chromium, corrosion resistant nickel based alloys, stainless steel (SUS 316), titanium, cobalt based alloys, and other metals and alloys, or combination thereof is deposited on the textile 4 to form a layer through the sputtering process.

Figure 2:
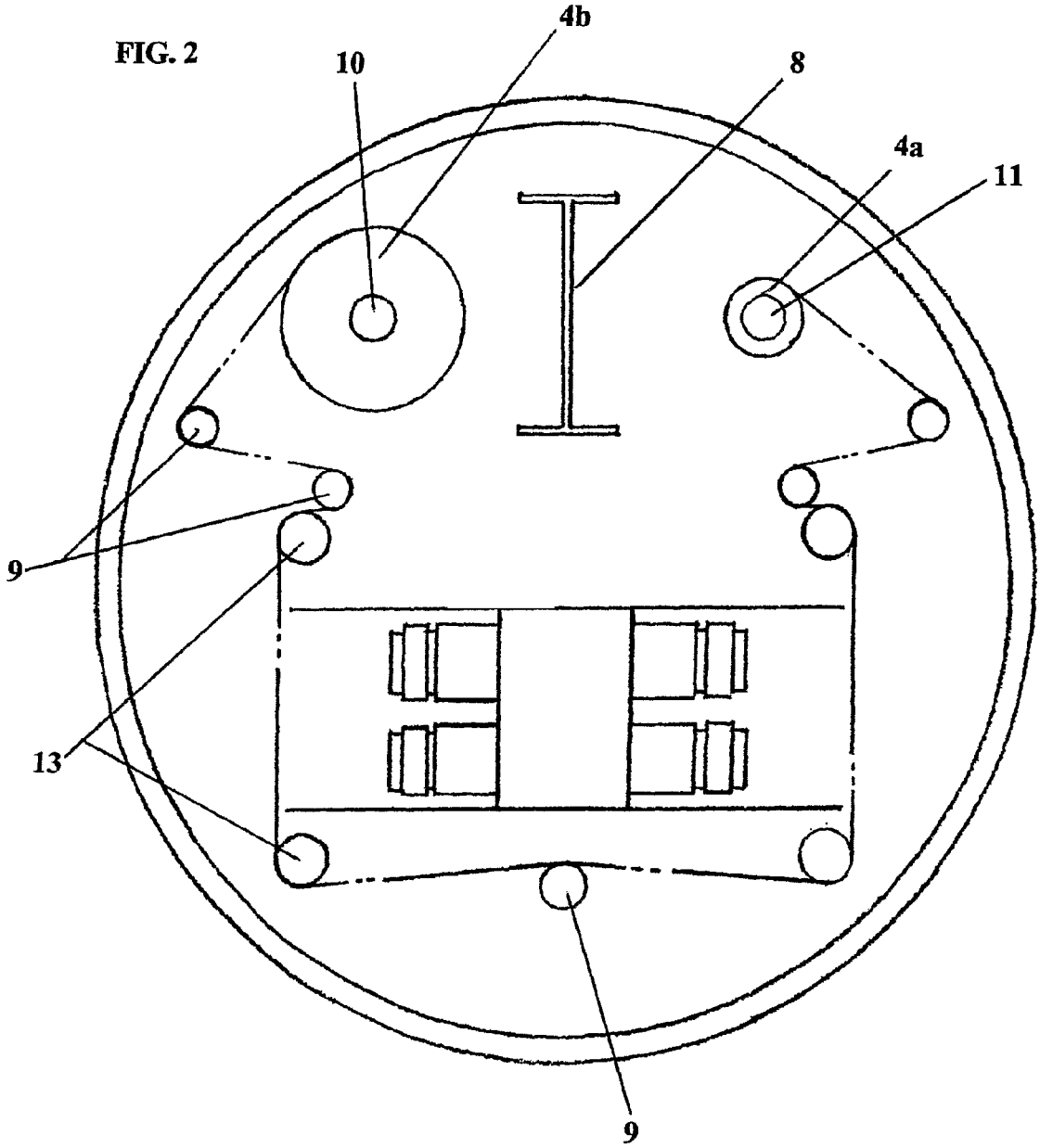
FIG. 2 is an example of sputtering apparatus.

The sputtering process occurs within the closed chambers of the sputtering apparatus, such as FIG. 2. Various adjustments to the positioning and placements of guide roll(s) 13, cylinder guard(s) 5, cylinder 6, target metal 12, and location of rewinding drum 10 and releasing drum 11 are possible as shown in FIG. 3 through 11.

First, the textile 4 to be sputter processed is prepared so the textile 4 is completely free from any resin material and other contaminants such as dirt, dust and other particles on the surface of the textile 4 to ensure even adhesion of the sputtered layer.

The textile 4 may be washed with water, solution with 0.5% to 10% concentration of NaOH, or other type of solution to remove any contaminants from the surface of the textile 4.

Whether the textile 4 is washed or not, it is also preferable to dry the textile 4 prior to processing. Drying time may vary from 30 minutes up to several hours, depending on the type of textile 4 and also whether the textile 4 was washed before the drying process. Generally, textile 4 made from polyethylene, polyester and other textile 4 with lower water absorption requires less drying time.

The length of textile 4 sold commercially usually comes in rolls of 50 meters. In order to increase the production efficiency, the rolls of textile 4 are sewn together to create a textile 4 with a length up to 1000 meters. This textile 4 is then wound onto releasing drum 11.

The sputtering apparatus consists of one closed chamber where the entire releasing drum 11 of textile 4 is placed inside the chamber. Once the textile 4 is place inside the chamber, air is pumped out of the chamber using a pump for a period of 30 minutes up to 3 hours to create a vacuum inside the chamber. First a pump is used to roughly remove air from the chambers to create a low level of vacuum. Then the main pump is utilized in combination of freezing panel (temperature −120~150 C.°) to increase suction of air out of the chamber to create a high level of vacuum.

Once a high level of vacuum is created inside the chamber, inert gas, such as argon is introduced into the chamber. The atmospheric pressure inside the chamber is to be adjusted to a range of $3\times10^{-4}$ to $9\times10^{-2}$ Torr.

To adjust oxidation of the metal to be sputtered, or nitrogenization of the metal to be sputtered, small amount of oxygen and/or nitrogen gas or air may be introduced into the chamber.

The amount of oxygen introduced into the chamber will control the amount of oxygenation of the metal sputtered and amount of nitrogen introduced into the chamber will control the amount of nitrogenation of the metal sputtered onto the textile 4.

The amount of oxygen, nitrogen, and/or air introduced into the chamber may be monitored using monitoring devise for optimum oxygenation and/or nitrogenation of the metal sputtered most suitable for the purpose and desired characteristic of the textile 4.

A DC voltage of 200 to 1000 volts is applied across the rod shaped sputter cathode(s) 7 and the anode or anodes. The application of voltage generates argon ions from the argon gas introduced into the chamber. If inert gas other than argon, ions of the inert gas are formed.

The ions of inert gas then collide with the metal target or targets 12 provided with the sputter cathode or cathodes 7 and ejecting the metal particles as it collides with the target. The ejected metal particles then collide with textile 4 and the metal particle is deposited on the surface of the textile 4.

When oxygen is introduced in the chamber, the metal particles may be oxidized as it travels through the chamber and when nitrogen is introduced in the chamber metal particles may be nitrogenized. Amount of oxidation and nitrogenization differs depending on the metal and the amount of oxygen and/or nitrogen introduced into the chambers.

When proper voltage is applied, and the metal particles are emitted from the metal target or targets 12, the metal particles may be fully or partially oxidized or nitrogenized as the particles travel through the chamber depending on the concentration of oxygen, nitrogen or air introduced into the chamber. As disclosed in U.S. Pat. No. 5,089,105, metal particles such as Titanium react with nitrogen present in the chamber and the deposit on the textile product form a golden color layer over the textile 4.

Figure 3A:
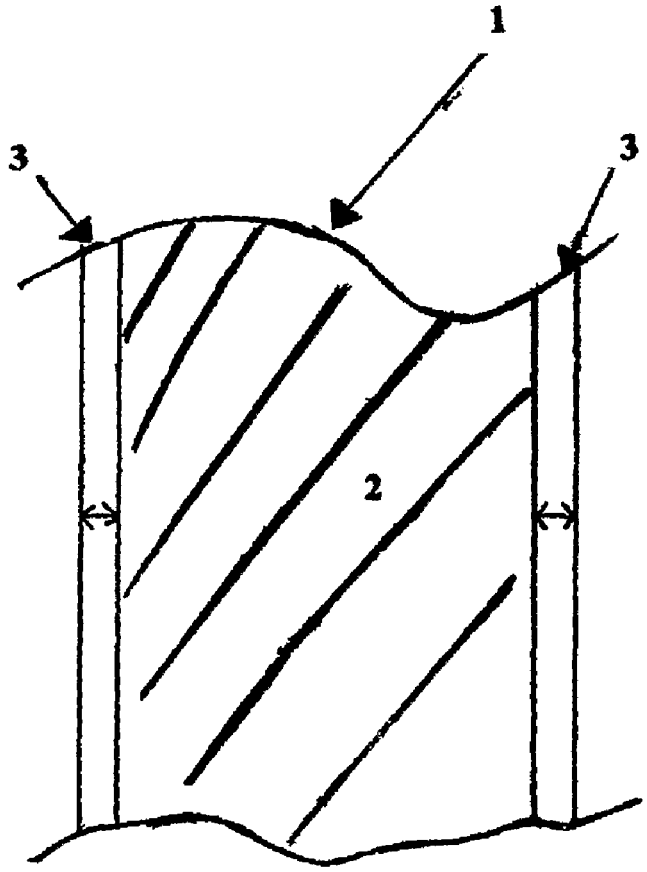
FIG. 3*a* is an example of sputtered processed film with area of metal deposit 2, and 1 to 3 cm edges 3 of area not sputtered by metal deposit.
Figure 3B:
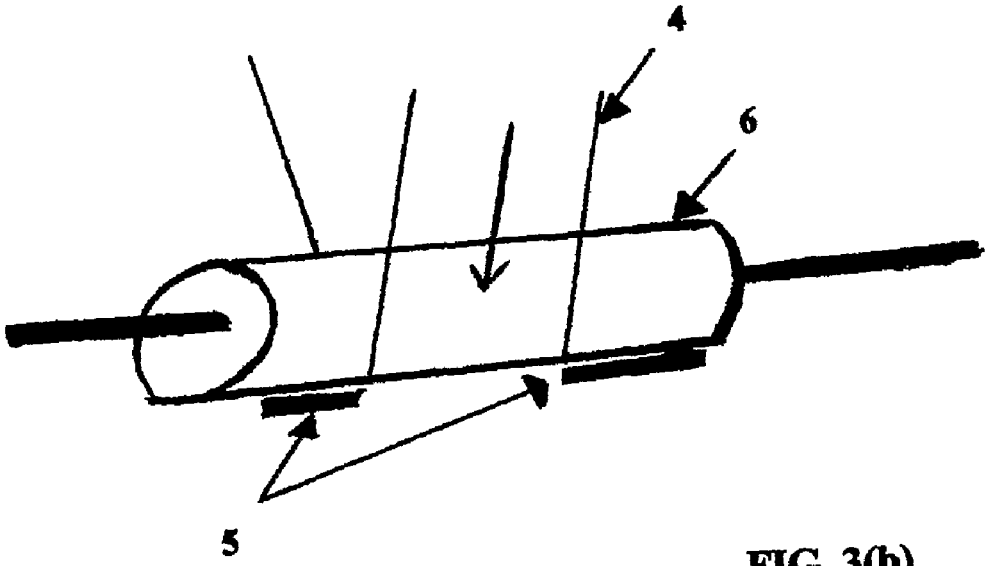
FIG. 3*b* is an example of how cylinder guards 5 allow sputtering metal deposit on to the entire width of the textile without metal deposit attaching onto the cylinder 6.

During the sputtering process, the backside of the textile 4 does not necessary have to be cooled. Generally, the sputtering process is performed for films while the material travels along the cylinder 6. When processing film 1, as shown in FIG. 3, the area of metal deposit 2 does not extend to the edges 3 of the film. The edges 3 are not sputtered with metal. Unlike textile 4 which loses value when the deposit does not cover the entire surface, the value of film 1 is not lost because of the uncovered edges 3.

When processing textile 4*b*, heat does not spread as much as film 1, therefore it is not necessary to cool the textile 4 while processing since the textile 4 would not melt or shrink due to the heat created from the sputtering process, although when sputtering on textile 4, the sputtering may occur as the unprocessed textile 4*a* travel from releasing drum 11 to a cylinder 6 which may be cooled.

The width of the textile 4 to be processed is readily adjustable, and the apparatus is designed so attachments are not necessary. Depending on the design and adjustment of the sputtering chamber and the arrangement of the metal target(s) 12 , sputter cathode(s) 7 and the textile 4, the textile 4 may travel along a cylinder 6 that may or may not be cooled.

The various arrangements of tensions controller(s) with tension meter 9 and cylinder 6 removes any slack, bends, or folds in the textile while it is processed, further improving the accuracy and reducing the variance in the thickness of the metal layer deposited on the textile 4.

When textile is sputtered while traveling over a cylinder 6, a cylinder cover 5 cover must be placed over the cylinder as in FIG. 3 to avoid sputtered material from attaching to the cylinder 6. By placing a cylinder cover 5, the cylinder 6 may be used repeatedly for sputtering without cleaning, further improving productivity as well as the product quality.

Also by covering the cylinder 6, the entire width of the textile 4 may be sputtered, without the concern for sputtered metal attaching to the cylinder 6, again increasing the productivity as well as value of the processed textile 4*b* as the entire width of the textile 4 is covered with the deposit. When the entire width of the textile 4 is deposited with the metal layer, the processed textile 4*b* maintains a high commercial value.

The sputtering process occurs while the textile 4 travels vertically. While the textile 4 is sputter processed, pieces of metal forms and falls. By processing the textile 4 as it travels vertically, the falling pieces of metal does not fall on the material or sputter cathode 7, and the process is stabilized. Also by avoiding the metal particles to fall on the textile 4 itself, the product quality improves with higher adhesion and more even and highly precise thickness of layer deposited on the textile 4.

Also the textile wound onto releasing drum 11 is placed in the chamber and the sputtering process, including winding, rewinding, and the actual sputtering are all performed within one chamber. This increases the efficiency of the process.

Figure 9:
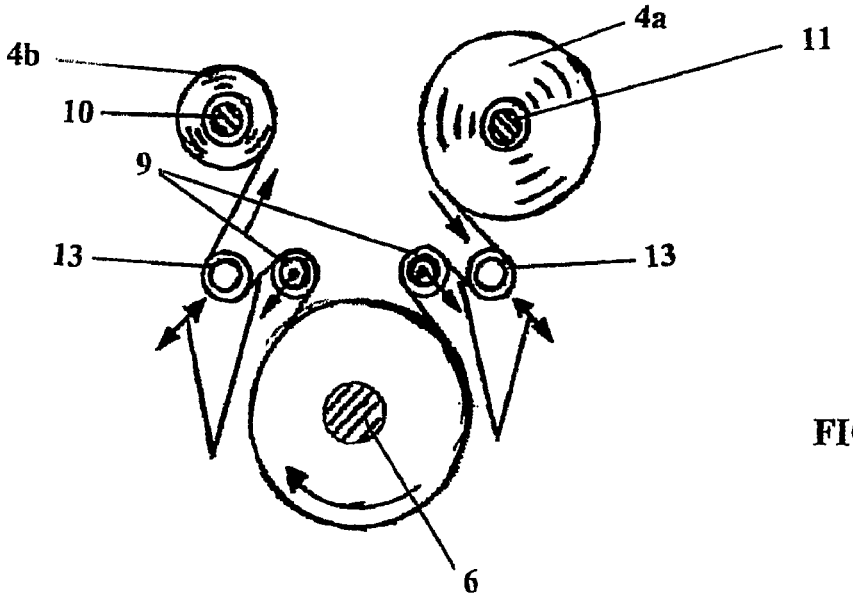
FIG. 9 is an arrangement example of releasing drum 11, rewinding drum 10, cylinder 6, and tension controller with tension meter 9, and guide rolls 13.
Figure 10:
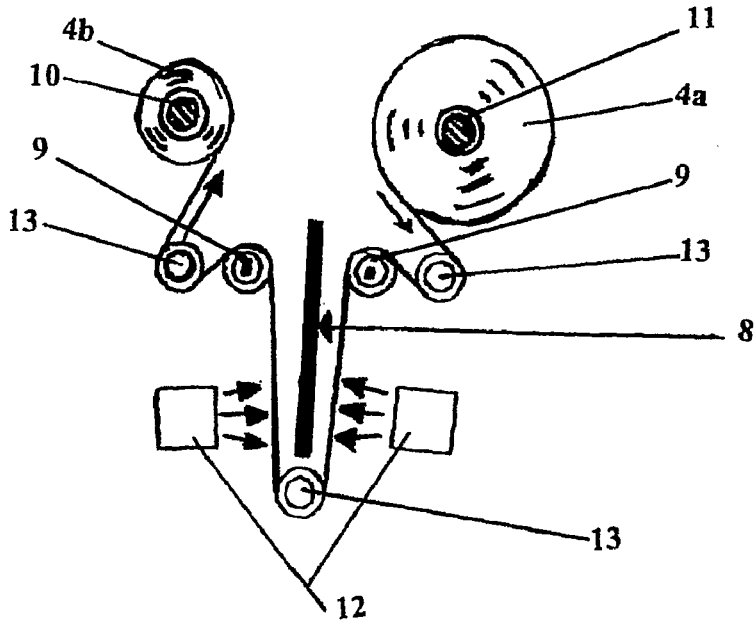
FIG. 10 is an arrangement example of releasing drum 11, rewinding drum 10, guard plate 8 tension controller with tension meter 9, metal targets 12 and guide rolls 13.
Figure 11:
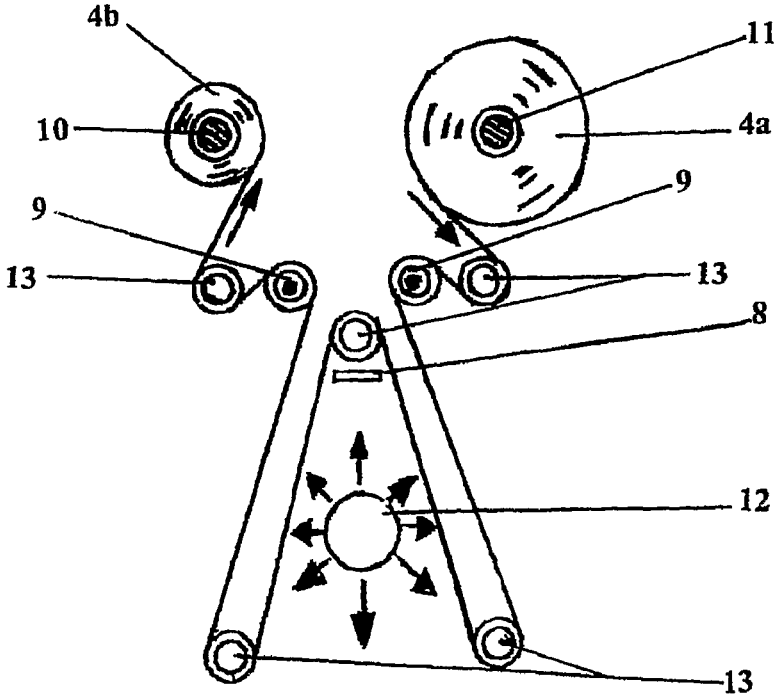
FIG. 11 is an arrangement example of releasing drum 11, rewinding drum 10, guard plate 8 tension controller with tension meter 9, metal target 12 and guide rolls 13.

The positioning of the guide roll(s) 13 and guard plate(s) 8 is set up in a manner that the guard plate 8 prevents metal from attaching to the interior of the chamber of the sputtering apparatus as illustrated in FIGS. 10 and 11. The guard plate(s) 8 is used to cover the textile 4 and interior of the sputtering apparatus which sputtered metals easily adhere to. Variations and adjustments to the set up are illustrated in FIGS. 7 through 11. By avoiding metals from attaching to the sputtering apparatus as well as the textile 4 being processed from angles and location not intended for the sputtering to occur, quality of the processed textile 4*b* increases.

The guide rolls 13 are positioned as shown in FIGS. 6 through 11. Especially the set up illustrated in FIGS. 8 through 11, prevents the textile 4 from folds, wrinkles, and bending. Addition of guide rolls 13 and tensions controller with tension meter 9 are especially effective to improve the quality of the processed textile 4*b* when the textile 4 processed has some elasticity.

Also to improve the adhesion of the metal, it is preferable the angle θ between textile 4 sputtered and sputter cathode 7 to be adjusted to an angle between 5 to 45 degrees as shown in FIG. 4.

The processed textile 4*b* produced utilizing the production detailed above were tested for various quality, including its anti-bacterial quality, deodorizing quality, and adhesiveness.

The result of the tests are organized in the Charts 1 and 2.

Chart 1. Antibacterial Property

| Type of Bacteria [2] | Cloth Tested | Number of bacteria/cloth tested | Log [1] | Bacteriostatic Activity Log B – Log C | Sterilization Activity Log A – Log C |
|---|---|---|---|---|---|
| *Staphylococcus aureus* | Beginning of experiment for both cloth | A: $2.4 \times 10^4$ | LogA: 4.3 | | |
| | Standard Cloth after 18 hours | B: $8.3 \times 10^6$ | LogB: 6.9 | | |
| | Silver Titanium Sputter Coated Cloth after 18 hours | C: under 20 | LogC: under 1.3 | Over 5.6 | Over 3.0 |
| *Klebsiella pneumoniae* | Beginning of experiment for both cloth | A: $3.0 \times 10^4$ | LogA: 4.4 | | |
| | Standard Cloth after 18 hours | B: $3.7 \times 10^7$ | LogB: 7.5 | | |
| | Silver Titanium Sputter Coated Cloth after 18 hours | C: under 20 | LogC: under 1.3 | Over 6.2 | Over 3.1 |

-continued

| Type of Bacteria [2] | Cloth Tested | Number of bacteria/cloth tested | Log [1] | Bacteriostatic Activity Log B – Log C | Sterilization Activity Log A – Log C |
|---|---|---|---|---|---|
| *Staphylococcus aureus* | Beginning of experiment for both cloth | A: $2.3 \times 10^4$ | LogA: 4.3 | | |
| | Standard Cloth after 18 hours | B: $1.9 \times 10^5$ | LogB: 7.2 | | |
| | Silver Titanium Sputter Coated Cloth(washed 5 times [3]) after 18 hours | C: under 20 | LogC: under 1.3 | Over 5.9 | Over 3.0 |
| *Klebsiella pneumoniae* | Beginning of experiment for both cloth | A: $1.4 \times 10^4$ | LogA: 4.1 | | |
| | Standard Cloth after 18 hours | B: $5.7 \times 10^7$ | LogB: 7.7 | | |
| | Silver Titanium Sputter Coated Cloth after 18 hours | C: under 20 | LogC: under 1.3 | Over 6.4 | Over 2.8 |
| *Staphylococcus aureus* | Beginning of experiment for both cloth | A: $1.2 \times 10^4$ | LogA: 4.0 | | |
| | Standard Cloth after 18 hours | B: $3.7 \times 10^7$ | LogB: 7.5 | | |
| | Silver Titanium Sputter Coated Cloth after 18 hours | C: under 20 | LogC: under 1.3 | Over 6.2 | Over 2.7 |
| | Silver Titanium Sputter Coated Cloth (washed 5 times) after 18 hours | C: under 20 | LogC: under 1.3 | Over 6.2 | Over 2.7 |

[1] For the test to be valid: logB – logA > 1.5
[2] For bacterial solution contained 0.05% of Tween 80 (surfactant)
[3] Washing method: High temperature acceleration (JAFET standard combination detergent used)
JAFET—Japan Association for the Functional Evaluation of Textile Chart 2. Deodorizing Property

| | | SUS Product | | Ti Product | |
|---|---|---|---|---|---|
| | | No washing | Washed in Water | No washing | Washed in Water |
| Formaldehyde Deodorization | Concentration(PPM) | 23/35 | 25/35 | 25/35 | 27/35 |
| | Amount Deodorized (%) | 34.3 | 28.6 | 28.6 | 22.9 |
| Acetaldehyde Deodorization | Concentration(PPM) | 110/120 | 120/120 | 120/120 | 120/120 |
| | Amount Deodorized (%) | 8.3 | 0.0 | 0.0 | 0.0 |
| Amonia Deodorization | Concentration(PPM) | 40/130 | 40/130 | 20/130 | 30/130 |
| | Amount Deodorized (%) | 89.2 | 69.2 | 84.6 | 76.9 |
| Acetic Acid Deodorization | Concentration(PPM) | 6/40 | 8/40 | 7/40 | 5/40 |
| | Amount Deodorized (%) | 85.0 | 80.0 | 82.5 | 87.5 |
| Hydrogen Sulfide Deodorization | Concentration(PPM) | 50/70 | 60/70 | 60/70 | 60/70 |
| | Amount Deodorized (%) | 28.6 | 14.3 | 14.3 | 14.3 |
| Isovaleric | Concentration(PPM) | 15/40 | 12/40 | 10/40 | 6/40 |

-continued

| | | SUS Product | | Ti Product | |
|---|---|---|---|---|---|
| | | No washing | Washed in Water | No washing | Washed in Water |
| Acid Deodorization | Amount Deodorized (%) | 62.5 | 70.0 | 75.0 | 85.0 |

As a result of the adjustments, high adhesion of the metal to the textile 4 is achieved as illustrated in Chart 2. The textile's added characteristics, therefore the adhered layer of metal that confer the characteristic, in this case the deodorizing effect, was not lost after five washing cycles as shown in Chart 2.

By implementing all the adjustment or combination of the adjustments in processing the textile 4 before, during and after the sputtering process, production efficiency is increased to make the process commercially viable, and product with high product quality and marketability is produced.

Under the third preferred embodiment, as shown in FIG. 4, the angle θ, the angle between the textile and the cathode is adjusted to be 5 to 45 degrees, which the adhesion of metal onto the textile increases.

Figure 6:
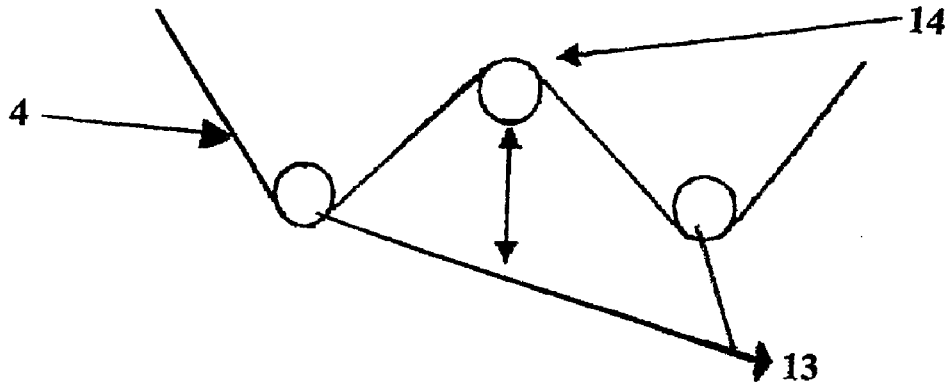
FIG. 6 is an example of an arrangement tension controller with tension meter 9.

Under the fourth preferred embodiment, as shown in FIG. 6, a tension controller with tension meter 9 is implemented between a pair of guide rolls 13 and within the line of textile's travel pass, which the tension of the textile 4 is controlled by the weight of the tension controller with tension meter 9 itself.

Figure 7:
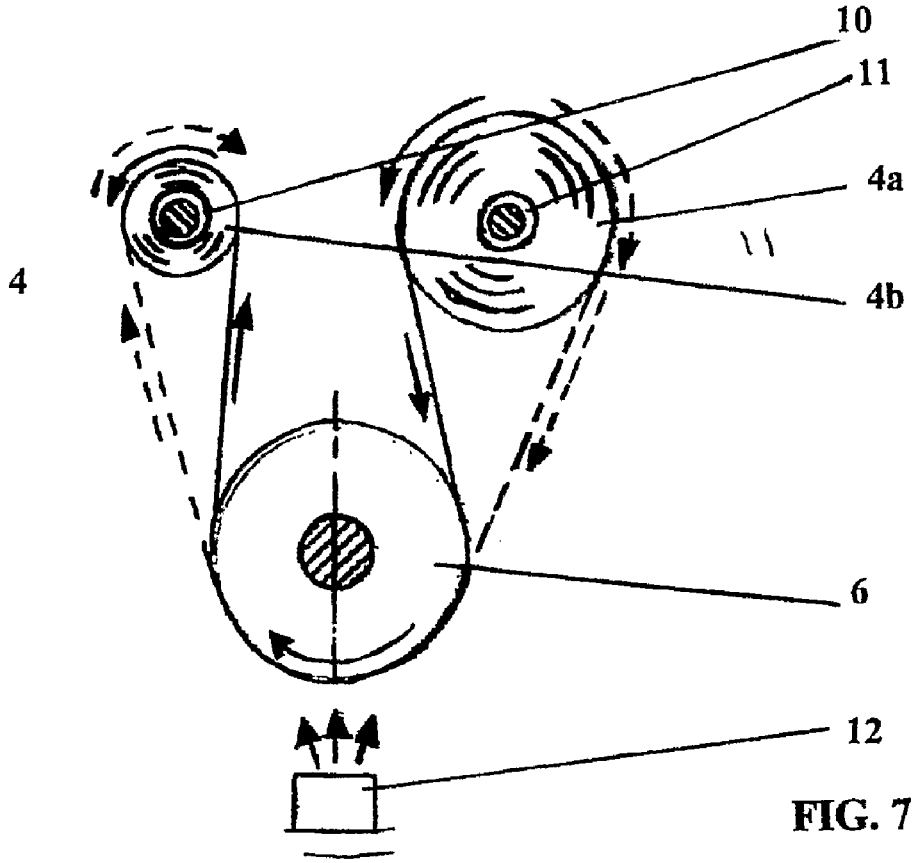
FIG. 7 is an arrangement example of releasing drum 11, rewinding drum 10, cylinder 6 and metal target 12.

Under the fifth preferred embodiment, as shown in FIG. 7, sputtering of metal occurs while the textile 4 travels over a cylinder 6. By implementing, the two drum arrangement, releasing drum 11 and rewinding drum 12 as shown, and allowing the two drums to rotate in either direction, showing the textile's travel path in solid line and dotted line, as the respective path of travel when the releasing drum 11 and rewinding drum 12 are rotated in the direction of dotted line and arrow and solid line and arrow.

Figure 8:
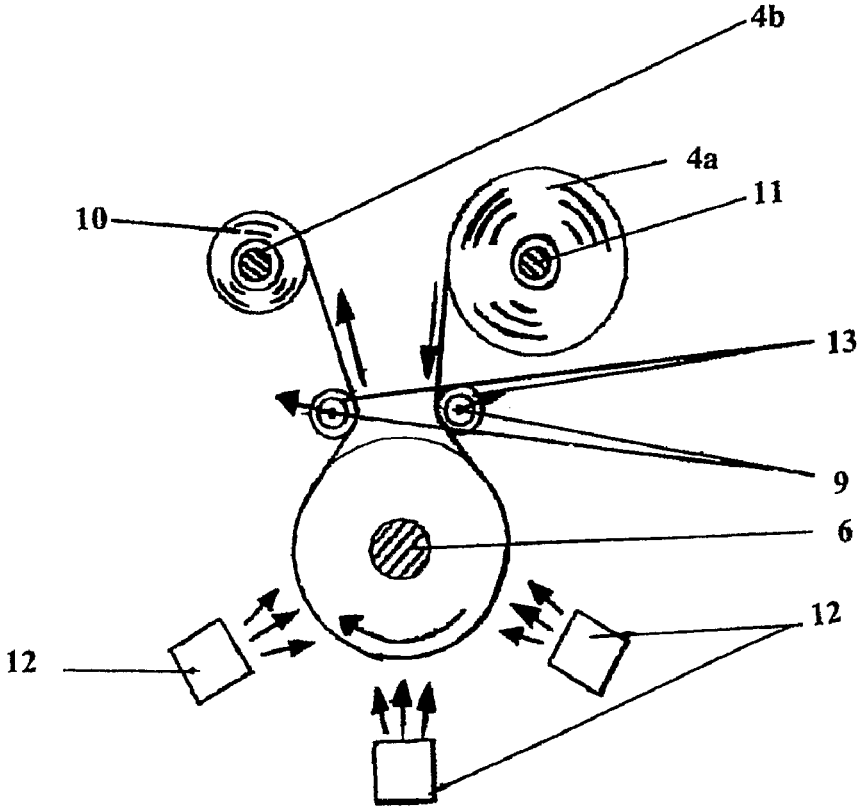
FIG. 8 is an arrangement example of releasing drum 11, rewinding drum 10, cylinder 6, tension controller with tension meters 9, guide rolls 13 and multiple metal targets 12.

Under the sixth preferred embodiment, as shown in FIG. 8, sputtering of metal occurs while the textile 4 travels over a cylinder 6, and the metal is sputtered from three metal targets 12, enabling the textile 4 to be sputtered with more metal, therefore thicker layer of metal deposited on the textile 4 when the textile 4 at same speed through another embodiment employing one or two metal targets 12. The textile 4 may also travel at a faster speed if same thickness of layer is desired, under this embodiment when compared to another embodiment employing only one or two metal targets 12.

Under the seventh preferred embodiment, tension controller with tension meter 9 on each side of the cylinder 6 and in between releasing drum 11 and rewinding drum 10, are two sets of tension controller with tension meter 9 and guide rolls 13 as shown in FIG. 9. The tension controller with tension meter 9 and guide roll 13 are arranged so the textile 4 traveling from the releasing drum 11 to the guide roll 13, the textile 4 traveling from the guide roll 13 to the tension controller with tension meter 9 and the textile 4 traveling from the tension controller with tension meter 9 to the cylinder 6, are all parallel to each other as shown by the arrows in FIG. 9. The tension controller with tension meter 9 and guide rolls 13 are also arranged so the textile 4 traveling from the cylinder 6 to the tension controller with tension meter 9, the textile 4 traveling from the tension controller with tension meter 9 to the guide roll 13, and the textile 4 traveling from the guide roll 13 to the rewinding drum 10, are also all parallel to each other as shown in FIG. 9 by the arrows.

Under the eighth preferred embodiment shown in FIG. 10, the sputtering of textile 4 occurs while the textile 4 travels between a tension controller with tension meter 9 and a guide roll 13, and two metal targets 12 facing each other separated by a guard plate 8 are used. This embodiment is preferred for textile 4 with high heat resistance or when heat created from the sputtering process is low due to lower power input to the sputtering apparatus.

Under the ninth preferred embodiment shown in FIG. 11, metal target 12 is cylindrical in shape is used to sputter the textile 4.

The processed textile produced 4*b* under the above preferred embodiments have improved adhesion of metal layer that withstand repeated washing and layer of metal deposited in the range of 20 to 2000 angstrom have a less than 5% variance in thickness of the deposited layer for the entire length and width of the textile 4, which the textile's 4 width is up to 10000 mm and length of the textile 4 is up to and over 1000 m.

What is claimed is:

1. A method for manufacturing textile product with a maximum width of up to and over 10000 millimeter and maximum length of up to and over 1000 meters, comprising of fiber and a sputtered metal layer of thickness between 20 to 2000 angstrom formed on the surface of said fiber, said metal layer covering the entire width and length of the said textile product, said method comprising the steps of:

(a) pre-washing the textile with water or NaOH solution of concentration between 0.5 to 10%;

(b) drying the textile for a period of 30 minutes to 3 hour;

(c) sewing the textile to form a textile with a length up to and over 1000 meters wound onto a drum;

(d) selecting the type of sputtering apparatus and metal to be sputtered on the textile depending on the heat resistance of the textile to be sputtered, thickness of the layer to be sputtered, and depending on the characteristics to be conferred on the textile;

(e) placing the drum in a sputtering apparatus;

(f) sputtering processing the textile with at least one or any combination of metal, oxidized metal, and nitrogenized metal while the textile travels over a cylinder of the sputtering apparatus;

(g) covering the cylinder with a cover to prevent the sputtered metal from adhering to the cylinder;

(h) selectively and adjustably cooling with a cooling mechanism, which is provided with the cylinder, one of frontside and backside surfaces of the textile depending on the heat resistance of the textile and power input to the cathodes while the sputtering processing occurs; and (i) inspecting, cutting and winding the textile into rolls of approximately 50 meter.

2. A method for manufacturing textile product with a maximum width of up to and over 10000 millimeter and maximum length of up to and over 1000 meters, comprising of fiber and a sputtered metal layer of thickness between 800 to 2000 angstrom formed on the surface of said fiber, said metal layer covering the entire width and length of the said textile product, with said metal layer having a variance of less than 5%, said method comprising the steps of:

(a) pre-washing the textile with water or NaOH solution of concentration between 0.5 to 10%;

(b) drying the textile for a period of 30 minutes to 3 hour;

(c) sewing the textile to form a textile with a length up to and over 1000 meters wound onto a drum;

(d) selecting the type of sputtering apparatus and metal to be sputtered on the textile depending on the heat resistance of the textile to be sputtered, thickness of the layer to be sputtered, and depending on the characteristics to be conferred on the textile;

(e) placing the drum in a sputtering apparatus;

(f) sputtering processing the textile with at least one or any combination of metal, oxidized metal, and nitrogenized metal while the textile travels over a cylinder of the sputtering apparatus;

(g) covering the cylinder with a cover to prevent the sputtered metal from adhering to the cylinder;

(h) selectively and adjustably cooling with a cooling mechanism, which is provided with the cylinder, one of frontside and backside surfaces of the textile depending on the heat resistance of the textile and power input to the cathodes while the sputtering processing occurs; and (i) inspecting, cutting, and winding the textile into rolls of approximately 50 meter.

3. The method defined in claim 1, wherein two or more metal targets are used to sputter the metal on to the textile.

4. The method defined in claim 1, wherein two or more tension controller with tension meter are used to monitor tension, providing feedback information to control speed and torque of the rotating drums, and two or more guide rolls are used to guide the direction of textile and to prevent folds and bends to the textile.

5. The method defined in claim 2, wherein two or more metal targets are used to sputter the metal on to the textile.

6. The method defined in claim 2, wherein two or more tension controller with tension meter are used to monitor tension, providing feedback information to control speed and torque of the rotating drums, and two or more guide rolls are used to guide the direction of textile and to prevent folds and bends to the textile.

7. A method for manufacturing textile product with a maximum width of up to and over 10000 millimeter and maximum length of up to and over 1000 meters, comprising of fiber and a sputtered metal layer of thickness between 20 to 2000 angstrom formed on the surface of said fiber, said metal layer covering the entire width and length of the said textile product, said method comprising the steps of:

(a) pre-washing the textile with water or NaOH solution of concentration between 0.5 to 10%;

(b) drying the textile for a period of 30 minutes to 3 hour;

(c) sewing the textile to form a textile with a length up to and over 1000 meters wound onto a drum;

(d) selecting the type of sputtering apparatus and metal to be sputtered on the textile depending on the heat resistance of the textile to be sputtered, thickness of the layer to be sputtered, and depending on the characteristics to be conferred on the textile;

(e) placing the drum in a sputtering apparatus;

(f) providing the sputtering apparatus with a sputter cathode and a substantially straight path through which the textile travels while being sputtered;

(g) adjustably providing an angle between an active surface of the sputter cathode and a surface of the textile traveling in the substantially straight path;

(h) sputtering processing the textile with at least one or any combination of metal, oxidized metal, and nitrogenized metal; and (i) inspecting, cutting and winding the textile into rolls of approximately 50 meter.

8. The method defined in claim 7, wherein the angle provided is between 5 and 45 degrees.

9. The method defined in claim 7, wherein the sputtering apparatus is provided with a metal target having a cylindrical shape.

* * * * *